US011339741B2

(12) United States Patent
Eto

(10) Patent No.: US 11,339,741 B2
(45) Date of Patent: May 24, 2022

(54) WATER JACKET

(71) Applicant: HONDA MOTOR CO., LTD., Tokyo (JP)

(72) Inventor: Koichi Eto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/212,026

(22) Filed: Mar. 25, 2021

(65) Prior Publication Data

US 2021/0301757 A1 Sep. 30, 2021

(30) Foreign Application Priority Data

Mar. 31, 2020 (JP) ..... JP2020-062473

(51) Int. Cl.
*F02F 1/16* (2006.01)
*F02F 1/14* (2006.01)
*F01P 7/14* (2006.01)

(52) U.S. Cl.
CPC ..... *F02F 1/16* (2013.01)

(58) Field of Classification Search
CPC ..... F02F 1/14; F02F 1/10; F02F 2001/104; F02F 1/36; F01P 2003/021; F01P 7/14
See application file for complete search history.

(56) References Cited

U.S. PATENT DOCUMENTS

2011/0023799 A1* 2/2011 Lenz ..... F02F 1/40 123/41.82 R
2014/0283763 A1 9/2014 Wakamoto et al.
2014/0331947 A1* 11/2014 Beyer ..... F02F 1/108 123/41.74
2015/0300236 A1* 10/2015 Beyer ..... F02F 1/108 123/41.74
2015/0361862 A1* 12/2015 Williams ..... F02F 1/36 123/41.01
2016/0069248 A1* 3/2016 Beyer ..... F01P 3/02 123/41.74

(Continued)

FOREIGN PATENT DOCUMENTS

JP H04-350348 A 12/1992
JP 2000-291488 A 10/2000

(Continued)

OTHER PUBLICATIONS

Office Action dated Nov. 2, 2021, issued in counterpart JP application No. 2020-062473, with English translation. (6 pages).

*Primary Examiner* — Long T Tran
(74) *Attorney, Agent, or Firm* — Westerman, Hattori, Daniels & Adrian, LLP

(57) ABSTRACT

A water jacket includes: a cooling channel through which a coolant flows, the cooling channel being formed in a cylinder block in which a plurality of cylinders are formed such that the cooling channel is positioned outside the cylinders; and a cooling groove (slit) through which the coolant flows, the cooling groove being formed between adjacent ones of the cylinders. When a slit end portion is viewed in sectional view in a direction in which the cylinders are arranged, the slit end portion and a cylinder-block inner wall are continuous with each other via an inclined portion inclined so as to become thicker toward the cylinder-block inner wall.

7 Claims, 4 Drawing Sheets

(56) References Cited

U.S. PATENT DOCUMENTS

| | | | | |
|---|---|---|---|---|
| 2016/0195036 | A1* | 7/2016 | Mori | F02F 1/10<br>123/41.79 |
| 2016/0265472 | A1* | 9/2016 | Kawasaki | F02F 1/14 |
| 2018/0306095 | A1* | 10/2018 | Steiner | F01P 7/165 |

FOREIGN PATENT DOCUMENTS

| | | | |
|---|---|---|---|
| JP | 2014-208992 | A | 11/2014 |
| JP | 2015-078632 | A | 4/2015 |
| JP | 5964092 | B2 | 8/2016 |

* cited by examiner

WATER JACKET

CROSS REFERENCES TO RELATED APPLICATIONS

The present application claims priority under 35 U.S.C. § 119 to Japanese Patent Application No. 2020-062473, filed Mar. 31, 2020, entitled "Water Jacket." The contents of this application are incorporated herein by reference in their entirety.

TECHNICAL FIELD

The present disclosure relates to a water jacket of a cylinder block of an internal combustion engine.

BACKGROUND

A water jacket known in the related art has the following configuration (for example, see Japanese Patent No. 5964092). A plurality of cylinder bores arranged in an axis direction of a crankshaft are formed in a cylinder block on which a cylinder head is placed. A cooling channel open to the cylinder head is formed so as to surround the cylinder bores. Regions of the cooling channel that are each positioned between corresponding adjacent ones of the cylinder bores are recessed portions recessed toward a cylinder-row center line connecting the centers of the cylinder bores. The recessed portions are each composed of a deep groove and a shallow groove. The deep groove has a depth substantially equal to that of another region of the cooling channel and is positioned farther from the cylinder-row center line. The shallow groove has a shallow depth and is positioned closer to the cylinder-row center line. The shallow groove is formed in the cylinder block. A spacer for flow rate control is fitted into the cooling channel. A regulating portion that controls coolant so as to flow mainly through the shallow groove is formed at the part of the spacer fitted into the recessed portion of the cooling channel in a state in which the regulating portion partly enters the shallow groove.

SUMMARY

To improve the cooling performance of a cylinder block, it can be proposed to dispose, between adjacent cylinders, a slit extending orthogonally to a direction in which cylinders are arranged.

However, when the cooling performance of a cylinder block is improved by disposing a slit between adjacent cylinders, variations in the temperatures of parts of the cylinder block are large, and a thermal stress is thus generated.

In addition, when a slit is disposed between adjacent cylinders, and cylinders are heated to be expanded, a compressive stress against the expansion is generated at the slit, and a stress concentration is thus caused.

The present application describes, for example, a water jacket capable of reducing the stress generated at a cylinder block even when a slit linked to a cooling channel is disposed between adjacent cylinders.

[1] A water jacket (for example, a water jacket 4 of an embodiment; the same shall apply hereinafter) according to a first aspect of the present disclosure includes: a cooling channel (for example, a cooling channel 4*c* of the embodiment; the same shall apply hereinafter) through which a coolant (for example, coolant of the embodiment; the same shall apply hereinafter) flows, the cooling channel being formed in a cylinder block (for example, a cylinder block 1 of the embodiment; the same shall apply hereinafter) in which a plurality of cylinders (for example, cylinder liners 2 of the embodiment; the same shall apply hereinafter) are formed such that the cooling channel is positioned outside the cylinders; and a cooling groove (for example, a slit 5 of the embodiment; the same shall apply hereinafter) through which the coolant flows, the cooling groove being formed between adjacent ones of the cylinders. When an end portion of the cooling groove (for example, a slit end portion 5*b* of the embodiment; the same shall apply hereinafter) is viewed in sectional view in a direction in which the cylinders are arranged (for example, a direction in which the cylinder liners 2 are arranged of the embodiment; the same shall apply hereinafter), the end portion of the cooling groove and an inner wall (for example, a cylinder-block inner wall 4*a* of the embodiment; the same shall apply hereinafter) of the cooling channel are continuous with each other via an inclined portion (for example, an inclined portion 6 of the embodiment; the same shall apply hereinafter) inclined so as to become thicker toward the inner wall of the cooling channel.

Accordingly, the end portion of the cooling groove and the inner wall of the cooling channel are continuous with each other via the inclined portion, and the thermal stress and the compressive stress generated at the cooling groove are dispersed via the inclined portion. Thus, it is possible to reduce the stress generated at the cylinder block even when the cooling groove linked to the cooling channel is disposed between adjacent ones of the cylinders.

[2] In the first aspect of present disclosure, preferably, a first curved side surface (for example, a first curved side surface 11 of the embodiment; the same shall apply hereinafter), a flat wall surface (for example, a flat wall surface 12 of the embodiment; the same shall apply hereinafter), and a second curved side surface (for example, a second curved side surface 13 of the embodiment; the same shall apply hereinafter) are continuous with each other between the adjacent ones of the cylinders, the first curved side surface extending so as to be curved from a position closer to a side wall of one of the adjacent ones of the cylinders, the flat wall surface being parallel to the direction in which the cylinders are arranged and extending toward another of the adjacent ones of the cylinders from a side edge of the first curved side surface, the second curved side surface extending so as to be curved from a side edge of the flat wall surface toward the other of the adjacent ones of the cylinders, and the cooling groove is disposed at the flat wall surface.

Accordingly, the cooling groove is disposed at the flat wall surface. Thus, thermal stress and compressive stress are unlikely to concentrate on the cooling groove. Accordingly, it is possible to reduce the stress generated at the cylinder block even when the cooling groove linked to the cooling channel is disposed between adjacent ones of the cylinders.

[3] A water jacket according to a second aspect of the present disclosure includes: a cooling channel through which a coolant flows, the cooling channel being formed in a cylinder block in which a plurality of cylinders are formed such that the cooling channel is positioned outside the cylinders; and a cooling groove through which the coolant flows, the cooling groove being formed between adjacent ones of the cylinders. A first curved side surface, a flat wall surface, and a second curved side surface are continuous with each other between the adjacent ones of the cylinders, the first curved side surface extending so as to be curved from a position closer to a side wall of one of the adjacent ones of the cylinders, the flat wall surface being parallel to a direction in which the cylinders are arranged and extending toward another of the adjacent ones of the cylinders from a side edge of the first curved side surface, the second curved side surface extending so as to be curved from a side edge of the flat wall surface toward the other of the adjacent ones of the cylinders, and the cooling groove is disposed at the flat wall surface.

Accordingly, the cooling groove is disposed at the flat wall surface. Thus, thermal stress and compressive stress are unlikely to concentrate on the cooling groove. Accordingly, it is possible to reduce the stress generated at the cylinder block even when the cooling groove linked to the cooling channel is disposed between adjacent ones of the cylinders. In the above explanation of the exemplary embodiment, specific elements with their reference numerals are indicated by using brackets. These specific elements are presented as mere examples in order to facilitate understanding, and thus, should not be interpreted as any limitation to the accompanying claims.

BRIEF DESCRIPTION OF THE DRAWINGS

The advantages of the disclosure will become apparent in the following description taken in conjunction with the following drawings.

DESCRIPTION OF THE PREFERRED EMBODIMENTS

A cylinder block including a water jacket of an embodiment of the present disclosure will be described with reference to the drawings.

Figure 1:
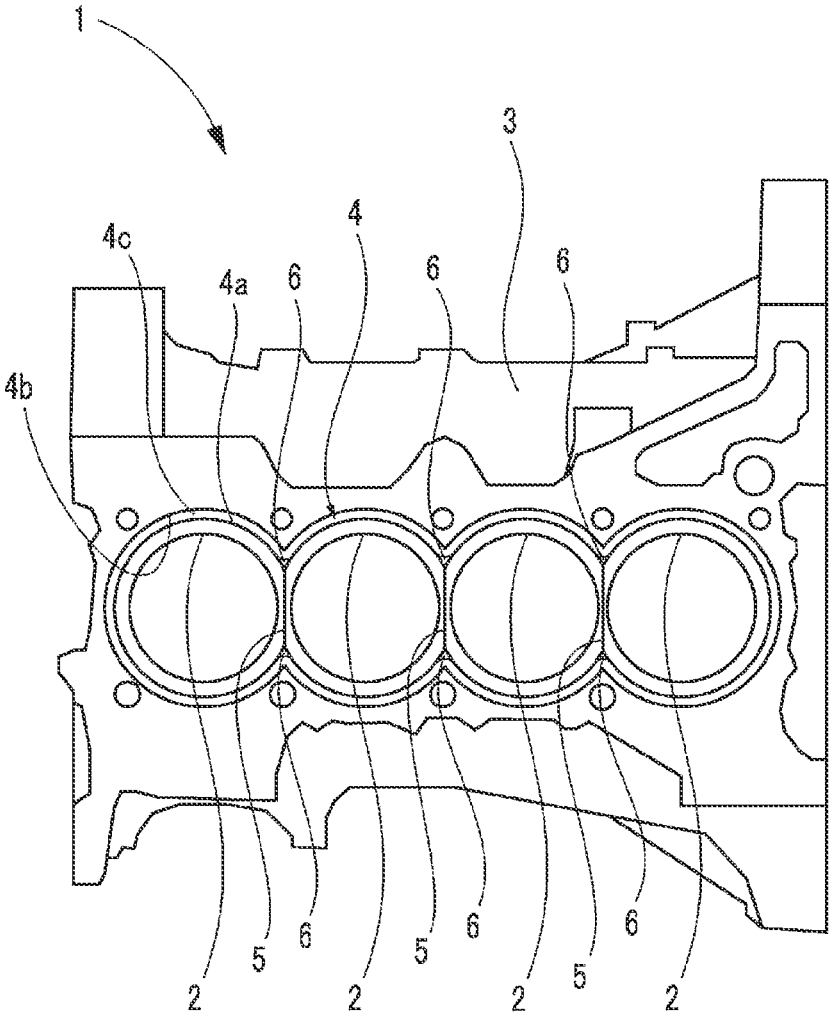
FIG. 1 is a diagram illustrating a cylinder block including a water jacket of an embodiment of the present disclosure.

Referring to FIG. 1, a cylinder block 1 of an internal combustion engine of the embodiment includes four cylinder liners 2, which correspond to cylinders of the present disclosure, a cylinder block body 3, which holds the cylinder liners 2, and a water jacket 4, which is disposed in the cylinder block body 3 so as to cover side surfaces of the cylinder liners 2.

The water jacket 4 includes a cooling channel 4*c*. The cooling channel 4*c* is defined by a cylinder-block inner wall 4*a*, which covers the cylinder liners 2, and a cylinder-block outer wall 4*b*, which is formed on the outside in a radial direction of each of the cylinder liners 2 so as to face the cylinder-block inner wall 4*a* with a space therebetween. Coolant (cooling water) flows in the water jacket 4 in a direction in which the cylinder liners 2 are arranged.

Figure 2:
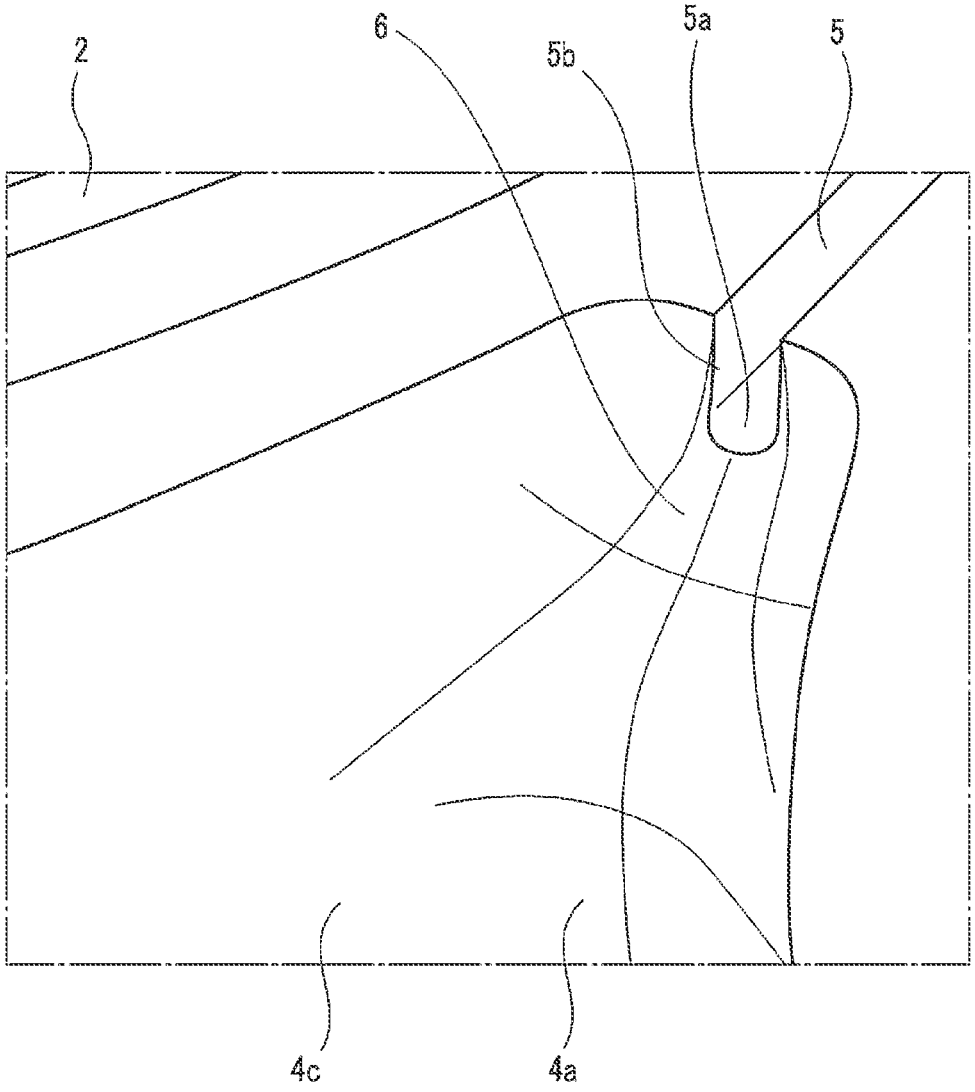
FIG. 2 is a perspective view illustrating an end portion of a slit of the embodiment.

Slits 5 (cooling grooves) are each disposed between corresponding ones of the cylinder liners 2. The slits 5 connect left and right regions into which the cooling channel 4*c* is divided by the cylinder liners 2 such that coolant can flow through the slits 5. Referring to FIG. 2, a slit bottom 5*a*, which is a bottom of the slit 5, is curved to avoid stress concentration.

Figure 3:
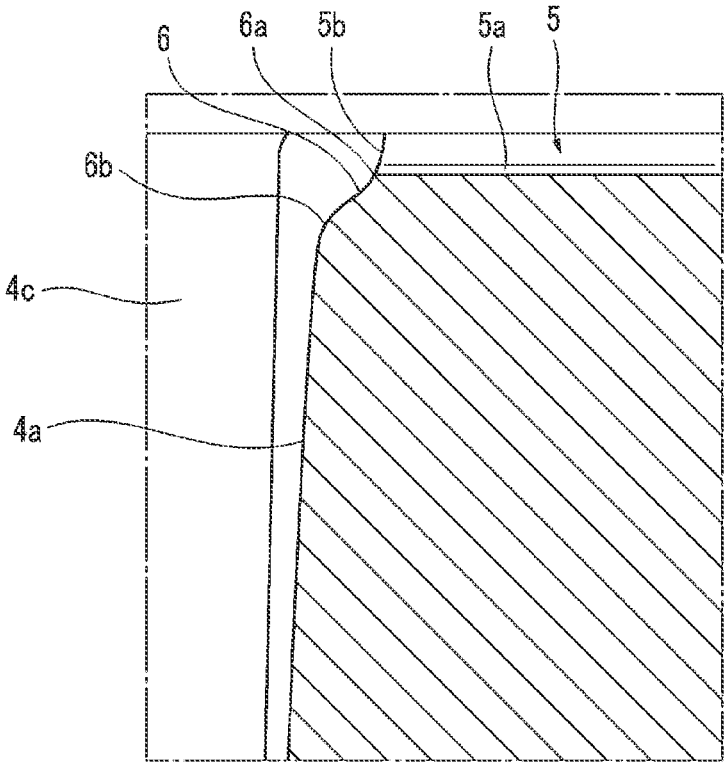
FIG. 3 is a sectional view illustrating an inclined portion of the embodiment.

Referring to FIGS. 2 and 3, when a slit end portion 5*b*, which is an end portion of the slit 5, is viewed in sectional view in the direction in which the cylinder liners 2 are arranged illustrated in FIG. 3, the slit end portion 5*b* and the cylinder-block inner wall 4*a* of the cooling channel 4*c* are continuous with each other via an inclined portion 6, which is inclined so as to become thicker toward the cylinder-block inner wall 4*a*. The inclination angle of the inclined portion 6 is larger than the draft angle of a die for the cylinder block 1. An upper-end curved portion 6*a* of the inclined portion 6, which is closer to the slit 5, and a lower-end curved portion 6*b* of the inclined portion 6, which is closer to the cylinder-block inner wall 4*a*, are disposed close to each other at a distance of, for example, 3 to 6 mm.

Figure 4:
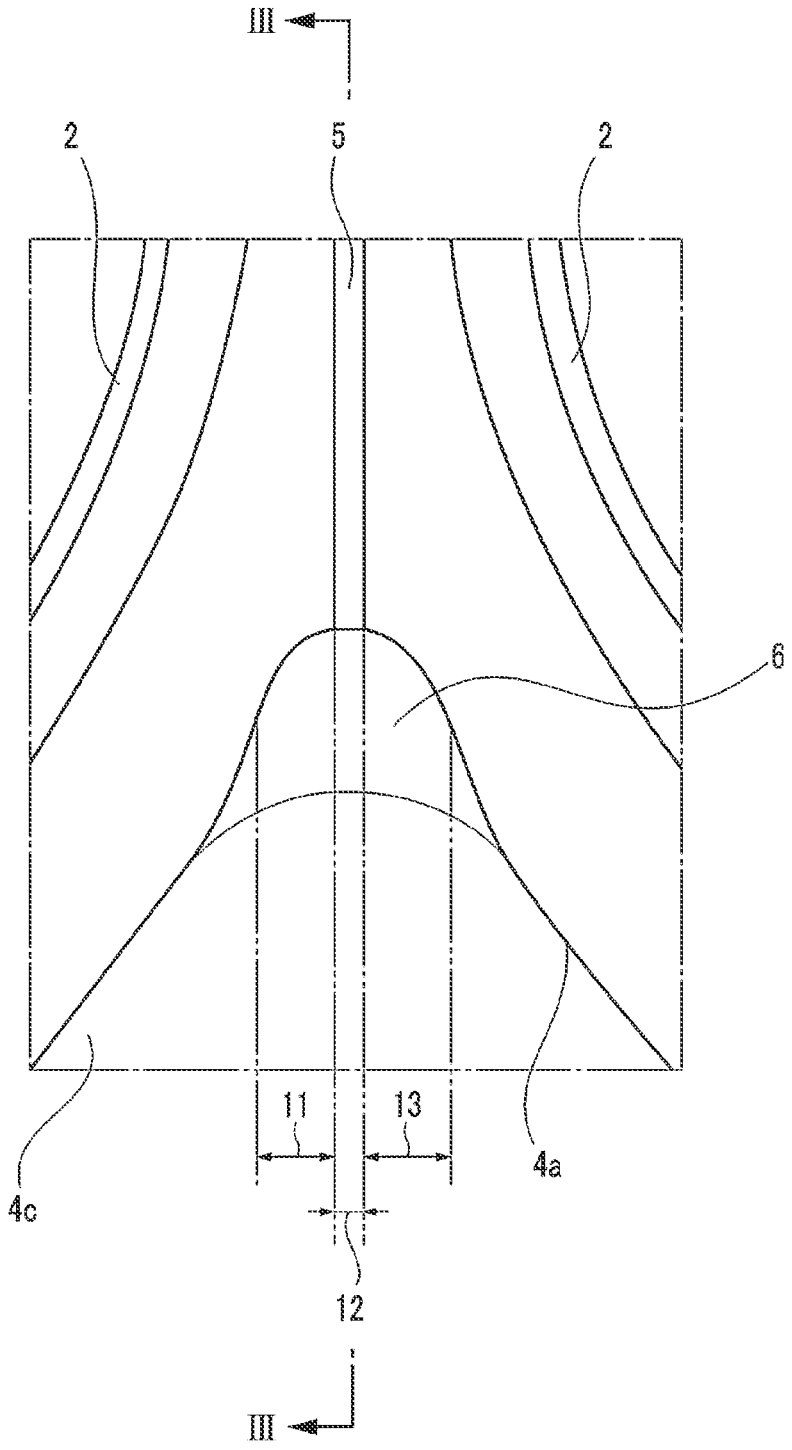
FIG. 4 is a plan view illustrating the end portion of the slit of the embodiment.

Referring to FIG. 4, a first curved side surface 11, a flat wall surface 12, and a second curved side surface 13 are continuous with each other between adjacent cylinder liners 2. The first curved side surface 11 extends so as to be curved such that the first curved side surface 11 is recessed from a position closer to the cylinder-block inner wall 4*a* covering one of the adjacent cylinder liners 2. The flat wall surface 12 is parallel to the direction in which the cylinder liners 2 are arranged and extends toward the other of the adjacent cylinder liners 2 from a side edge of the first curved side surface 11. The second curved side surface 13 extends so as to be curved from a side edge of the flat wall surface 12 toward the cylinder-block inner wall 4*a* covering the other of the adjacent cylinder liners 2.

The slit 5 is disposed such that the slit end portion 5*b* is positioned at the flat wall surface 12.

In the cylinder block 1 including the water jacket 4 of the embodiment, the slit end portion 5*b* and the cylinder-block inner wall 4*a* are continuous with each other via the inclined portion 6, and the thermal stress and the compressive stress generated at the slit 5 are dispersed via the inclined portion 6. Thus, it is possible to reduce the stress generated at the cylinder block 1 even when the slit 5 linked to the cooling channel 4*c* is disposed between adjacent cylinder liners 2.

In the embodiment, the slit 5 is disposed such that the slit end portion 5*b* is positioned at the flat wall surface 12. Thus, thermal stress and compressive stress are unlikely to concentrate on the slit 5 compared with the case in which a slit end portion is positioned at a curved surface. Accordingly, it is possible to reduce the stress generated at the cylinder block 1 even when the slit 5 linked to the cooling channel 4*c* is disposed between adjacent cylinder liners 2.

In the embodiment, the configuration in which all the slits 5 are connected to the cylinder-block inner wall 4*a* via the corresponding inclined portions 6 and are positioned at the corresponding flat wall surfaces 12 is described, but the configuration of the water jacket in the present disclosure is not limited thereto. For example, a configuration in which some slit end portions are connected to an inner wall of a cooling channel via the corresponding inclined portions or a configuration in which some slit end portions are positioned at the corresponding flat wall surfaces also enables an operational effect of stress reduction of the present disclosure to be achieved.

In addition, in the embodiment, the configuration in which three slits 5 are included is described, but the configuration of the slits in the present disclosure is not limited thereto. For example, the number of the slits may be one, two, or four or more. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

What is claimed is:

1. A water jacket comprising:

a cooling channel through which a coolant flows, the cooling channel being disposed in a cylinder block in which a plurality of cylinders are formed such that the cooling channel is positioned outside the cylinders; and a cooling groove through which the coolant flows, the cooling groove being disposed between adjacent ones of the cylinders, wherein the cooling groove comprises a slit end portion at an inner wall of the cooling channel, and when the slit end portion of the cooling groove is viewed in sectional view perpendicular to a direction in which the cylinders are arranged, the slit end portion of the cooling groove and the inner wall of the cooling channel are continuous with each other via an inclined portion inclined downward from the slit end portion of the cooling groove toward the inner wall of the cooling channel.

2. The water jacket according to claim 1, wherein in a plan view, a first curved side surface, a flat wall surface, and a second curved side surface are continuous with each other between the adjacent ones of the cylinders, the first curved side surface extending so as to be curved from a position closer to a side wall of one of the adjacent ones of the cylinders, the flat wall surface being parallel to the direction in which the cylinders are arranged and extending toward the other of the adjacent ones of the cylinders from a side edge of the first curved side surface, the second curved side surface extending so as to be curved from a side edge of the flat wall surface toward the other of the adjacent ones of the cylinders, and the cooling groove is disposed at the flat wall surface.

3. The water jacket according to claim 1, wherein the inclined portion is inclined downward toward the outside of cylinders.

4. The water jacket according to claim 3, wherein, in a plan view, the inclined portion becomes wider toward the outside of cylinders.

5. The water jacket according to claim 1, wherein, in the sectional view, the inclined portion includes a curved portion.

6. The water jacket according to claim 1, wherein, in the sectional view, the inclined portion includes an upper-end curved portion and a lower-end curved portion, the lower-end curved portion being continuous with the inner wall of the cooling channel.

7. The water jacket according to claim 6, wherein, in the sectional view, the upper-end curved portion has a concave-curved shape and the lower-end curved portion has a convex-curved shape.

* * * * *